United States Patent [19]

McMahon et al.

[11] 4,307,879

[45] Dec. 29, 1981

[54] ATHLETIC PLAYING SURFACE

[76] Inventors: Thomas A. McMahon, 65 Crest Rd., Wellesley, Mass. 02181; Peter R. Greene, 77 Lanark Rd., Apt. 1, Brookline, Mass. 02146

[21] Appl. No.: 947,101

[22] Filed: Sep. 29, 1978

Related U.S. Application Data

[63] Continuation-in-part of Ser. No. 826,335, Aug. 22, 1977, abandoned.

[51] Int. Cl.[3] ..... A63J 3/00

[52] U.S. Cl. ..... 272/3; 273/55 R; 273/DIG. 7; 273/DIG. 29

[58] Field of Search ..... 272/3, 4, 2, 100, 109, 272/134, 135, 136, 137, 70, 56.5 SS; 404/18, 29, 34, 35

[56] References Cited

U.S. PATENT DOCUMENTS

| | | | |
|---|---|---|---|
| 7,933 | 2/1851 | Ware | 404/43 |
| 535,831 | 3/1895 | Jessup | 14/43 |
| 738,174 | 9/1903 | Erwin | 272/3 |
| 750,954 | 2/1904 | Ellis | 272/56.5 SS |
| 1,233,200 | 7/1917 | Dessau | 272/3 UX |
| 1,509,750 | 9/1924 | Campbell | 272/134 |
| 1,693,655 | 12/1928 | Murphy | 52/402 |
| 1,747,352 | 2/1930 | Devine | 248/621 |
| 2,068,386 | 1/1937 | Otis | 272/66 |
| 2,167,696 | 8/1939 | Tetzman | 52/395 |
| 3,045,294 | 7/1962 | Livezey | 52/403 |
| 3,114,940 | 12/1963 | Rockabrand et al. | 267/153 |
| 3,271,916 | 9/1966 | Omholt | 52/393 |
| 3,438,312 | 4/1969 | Becker et al. | 272/3 UX |
| 3,634,895 | 1/1972 | Childers | 5/420 |
| 3,641,601 | 2/1972 | Sieg | 5/420 |
| 3,757,780 | 4/1973 | Trieschmann et al. | 272/3 X |
| 3,779,547 | 12/1973 | Pappas | 272/3 |
| 3,844,539 | 10/1974 | Abbott | 256/24 |
| 3,922,409 | 11/1975 | Stark | 272/3 X |
| 4,054,987 | 10/1977 | Florenza | 272/3 X |

FOREIGN PATENT DOCUMENTS

| | | | |
|---|---|---|---|
| 1021997 | 1/1958 | Fed. Rep. of Germany | 272/3 UX |
| 2316887 | 10/1973 | Fed. Rep. of Germany | 404/35 |
| 1071921 | 3/1954 | France . | |
| 2240320 | 3/1975 | France | 272/56.5 SS |
| 200728 | 7/1923 | United Kingdom . | |
| 1113244 | 5/1968 | United Kingdom . | |
| 1201226 | 8/1970 | United Kingdom . | |
| 1226445 | 3/1971 | United Kingdom | 272/3 |
| 1244157 | 8/1971 | United Kingdom | 272/3 |
| 1263731 | 2/1972 | United Kingdom | 272/3 |
| 1478850 | 7/1977 | United Kingdom | 272/3 |
| 596256 | 3/1978 | U.S.S.R. | 272/3 |

OTHER PUBLICATIONS

Material Titled "Improvements in Racing Tracks", submitted by applicant, Author and date not known.

*Primary Examiner*—Richard C. Pinkham
*Assistant Examiner*—Arnold W. Kramer
*Attorney, Agent, or Firm*—Kenway & Jenney

[57] ABSTRACT

An extended athletic playing surface that increases running speed of an athlete performing on the surface and reduces the likelihood of injury to the athlete has a multi-layer construction. The athlete's foot impacts on an upper surface of a sheet material that has a low mass per unit area and is stiffly resilient. The upper surface is supported on either discrete "bumper pads" of a resilient material, or preferably a combination of horizontal, spaced apart supports and bumper pads. The composite structure rests on a conventional surface such as a concrete base. The composite surface is characterized by a low effective vertical mass and a composite vertical compliance that is extremely large in comparison to any comparable known athletic surface. The surface also has a high effective horizontal mass and a low horizontal compliance. In the preferred form, this composite surface is also characterized by a mechanical response that is substantially independent of the point of the impact on the surface, independent of the area of the foot contact, and independent of the presence of other athletes on the surface.

26 Claims, 14 Drawing Figures

ATHLETIC PLAYING SURFACE

This application is a continuation-in-part application of U.S. Ser. No. 826,335, filed Aug. 22, 1977, now abandoned.

BACKGROUND OF THE INVENTION

This invention relates in general to athletic running and playing surfaces, specifically to a composite construction particularly adapted to running tracks and level playing fields for football and the like where it is desired to optimize the speed of a runner on the surface while at the same time reducing the likelihood of injuries.

Spring mounted floors or platforms have been known for a long time. U.S. Pat. Nos. 1,509,750; 1,747,352 and 2,167,696, for example, demonstrate small, special purpose devices that depress to some degree when a person stands on them. While some are related to athletics, none are designed for normal running. Known athletic surfaces such as running tracks, football fields, and playing surfaces for a wide variety of other sports typically have a conventional uniform construction including plain ground, grass over the ground, asphalt, gravel, and more recently, a layer of a resilient synthetic plastic material laid over the ground or concrete. These plastic materials, such as the products sold under the trade designation "Astroturf", "Chem-Turf", or "Tartan" are generally uniform in composition and thickness when applied to playing fields.

While these plastic surfaces enjoy a high degree of commercial success, they are not entirely satisfactory. First, they are comparatively expensive to install, particularly in the thick layers necessary to achieve large compliance. Second, in thin layers, such as $\frac{3}{8}$ to $\frac{3}{4}$ inch, the running surface has been found to produce a relatively high level of injuries. When the plastic layers are thick enough to significantly reduce injuries, they are poor running surfaces due to a relatively low horizontal shear modulus and a high dependence of vertical compliance on the foot contact area, e.g., full foot versus only toe or heel contact.

Surfaces specifically designed for running such as indoor and outdoor running tracks suffer from many of the difficulties enumerated above. Outdoor tracks are typically asphalt, clay, gravel deposited over the ground, or an artificial surface over concrete or some substantially rigid substratum. They are characteristically rigid and result in a usual high incidence of injuries such as shin splints and foot injuries due to the high collision forces generated by the human leg striking a rigid surface when running. These problems are, of course, accentuated for competitive runners and those who may not be in their best physical condition. Resilient layers on tracks, whether outdoors or indoors, may reduce injuries, but the principal uses of such surfaces is as a thin top layer to provide traction, reduce injury to the track from the track shoe spikes, and to provide a surface which is essentially maintenance-free.

Conventional construction for indoor running tracks uses an extremely stiff running surface laid on "sleepers" or elongated support members. Older tracks use stiff lengths of hardwood fixed to the stringers. Some more recent tracks have used other surface materials such as plywood overlaid with the resilient materials as discussed above. In either case, it has been assumed heretofore that the track surface should be generally rigid or highly stiff to yield the best possible running speeds on the track. Some other tracks have used plywood panels supported on several 2"×4" beams arranged perpendicular to the running direction. Such tracks provide some degree of vertical compliance, but their mechanical response (i.e. vertical compliance) varies greatly depending on whether or not a runner lands over a support beam or "sleeper".

U.S. Pat. Nos. 1,693,655 and 3,114,940 describe floors formed by conventional, interfitted (i.e. tongue-in-groove) floor boards that are supported over rigid subfloors on sleepers that in turn rest on a layer of yielding material. In the '655 system, the yielding material is a pad or cushion of felt or an equivalent held in a U-shaped support bracket. While this arrangement does provide some "give" to the floor, it is not suitable for use as an athletic surface, particularly a running track. First, the yielding material is designed to absorb energy from a runner, not return it to him. Second, the compliance of the surface is not uniform. If the runner's foot lands over a sleeper it is more rigid than if the foot lands between the sleepers. Third, the floor boards are not independently sprung, and hence feed energy from one place on the surface to another. For example, the impact of one runner can develop an upward movement of the floorboard at an adjacent point which exchanges energy between the runners. Finally, there is no appreciation in the prior art of a general mechanical interrelationship between the optimal vertical compliance of a running surface and the running speed attainable on that surface other than the long accepted understanding that the hardest track surfaces produce the fastest speeds.

The '940 patent provides a rubber pad secured by staples to sleepers that support a rigid, hardwood upper floor. The pad rests directly on the floor and grooves in the pad resist a horizontal shift of the pad or the floor with respect to a concrete subfloor. This system provides a floor structure with a relatively large apparent mass. As a result, there is no enhancement of running speed or reduction of injuries associated with running. Also, as with the '655 construction, the floorboards are not independently sprung so that they feed energy across the floorboards.

It is therefore a principal object of this invention to provide a construction for an athletic playing surface that enhances the running speed of athletes performing on the surface.

Another object is to provide a playing surface that reduces injuries to athletes performing on the surface.

Still another object is to provide a playing surface with the foregoing advantages that has a response over its surface that is highly uniform and independent of the foot contact area.

A further object is to provide a playing surface with the foregoing advantages that has a low cost of construction and a high degree of longevity.

Yet another object is to provide a playing surface that is substantially free of vibrational cross talk between different areas of the surface to avoid interaction between athletes.

Still another object is to provide a surface that can be used in a wide variety of environments and for a wide variety of sports.

SUMMARY OF THE INVENTION

An extended athletic playing surface has a multi-layer construction resting on a fixed, substantially rigid base that returns running impact energy to a runner in a highly efficient manner. The upper surface is formed of a sheet material that has a low vertical mass per unit surface area and is stiffly resilient. The upper surface is preferably an array or mosaic of relatively small, independent members or panels in adjacent or closely spaced relationship. This mosaic surface can be covered with a thin layer of a resilient material.

The upper surface is supported over the base by a series of horizontal, spaced apart members (sleepers) and discrete "bumpers pads" of a resilient material or, in some instances, the bumper pads alone. This composite structure presents to the runner a low effective vertical mass, a large vertical compliance (i.e. relative to conventional surfaces), and a mechanical response that is substantially uniform over the playing surface and independent of the foot impact area. Preferably the variation in vertical compliance is no greater than plus or minus 15% from one place to another on the surface.

This playing surface construction is also characterized by a high effective horizontal mass, a low horizontal compliance, and an absence of vibrational cross talk. In general, the playing surface is constructed to yield a vertical compliance (expressed as its inverse, a spring constant) of 5,000 to 35,000 lbf./ft, and preferably 2.0 to 3.0 times the spring constant of the athlete running on the surface. A recommended value for competition running is approximately 23,000 lbf./ft. Its effective vertical mass per panel (about ½ of its real mass) is preferably less than 1/10 the mass of the athlete performing on the track.

These and other objects and features of the invention are discussed in greater detail below with reference to the accompanying drawings.

DETAILED DESCRIPTION OF THE PREFERRED EMBODIMENTS

Figure 1:
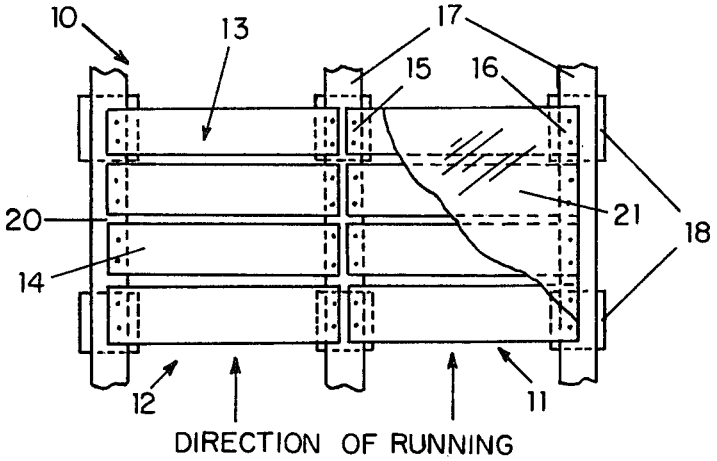
FIG. 1 is a plan view of two lanes of a running track constructed according to this invention with portions broken away.
Figure 2:
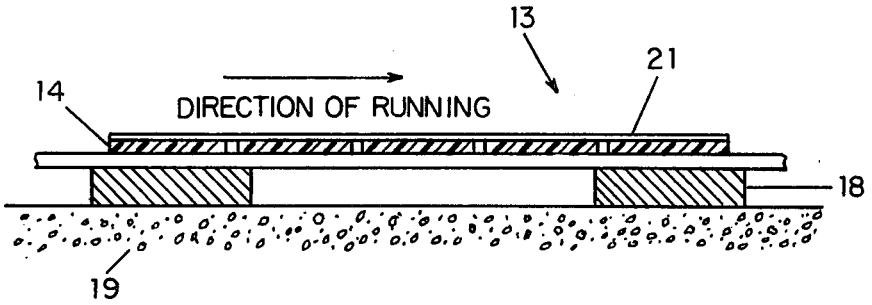
FIG. 2 is a view in side elevation of the running track shown in FIG. 1.
Figure 3:
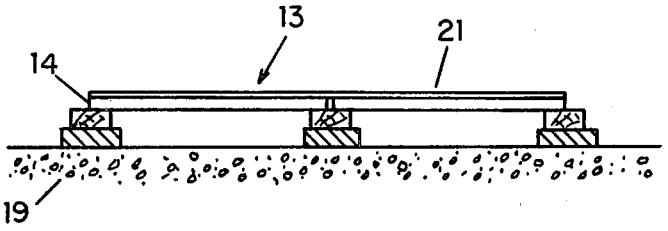
FIG. 3 is a view in end elevation of the running track shown in FIG. 1.

FIGS. 1–3 show a portion of a running track 10 constructed in accordance with the invention and two lanes 11 and 12 that are identical in construction. While only two lanes are shown, of course, additional lanes are usually provided. The track 10 can be straight (discontinuous) or continuous, in the shape of a circle or oval. It can be constructed indoors or outdoors and made permanent or portable.

The running lanes have an upper running surface 13 with a series of spaced apart members 14 supported at their ends 15, 16 by support rails or beams 17. These rails are in parallel rows, spaced from one another by the width of one lane which is typically 36 to 48 inches. Each pair of adjacent rails 17 thus supports one running lane of the track.

The rails 17 in turn rest upon discrete, spaced apart resilient members or "bumper pads" 18 which will be discussed in detail below. The pads 18 rest on a substantially rigid sub-layer 19 composed of materials such as a concrete, asphalt or a conventional wooden floor.

The members 14 are stiffly resilient and preferably formed of a glass fiber reinforced resinous material which provides not only the necessary load-deflection characteristics but also is highly fatigue resistant under cyclic loading and has a low internal energy absorption. One such material is available commercially from General Electric Company under the trade designation "G-10" (NEMA GRADE). "G-10" is an epoxy resin impregnated medium weave glass cloth having the mechanical properties indicated below:

| | |
|---|---|
| Compression Strength (lb./sq.in.) | $50 \times 10^3$ |
| Flexural Strength (lb/sq.in.) face-lengthwise | $80 \times 10^3$ |
| Flexural Strength (lb/sq.in.) face-crosswise | $60 \times 10^3$ |
| Tensile Strength (lb/sq.in.) crosswise | $38 \times 10^3$ |
| Flexural Modulus of Elasticity (lb/sq.in.) face-lengthwise | $1.90 \times 10^3$ |
| Flexural Modulus of Elasticity (lb/sq.in.) face-crosswise | $1.80 \times 10^3$ |

Typical dimensions for the members 14 are ⅜ inch thick by 12 inches wide by 3 feet long.

A principal feature of this invention is the bumper pads 18. They must (1) be highly resilient (i.e. exhibit minimal internal damping), (2) be resistent to creep, that is, they must maintain their shape under the constant loading of the weight of the track, (3) they should exhibit minimal changes in their mechanical properties with changes in temperature and humidity, and (4) be stable enough to maintain their original specified properties for 10 to 15 years. The last two characteristics are particularly important in the construction of outdoor tracks. Silicone rubber has been found to meet all of these requirements, but other less expensive materials such as neoprene can also be used with some sacrifice in performance. An acceptable silicone rubber is grade 300 to 700 "Cohrlastic" sold by the Connecticut Hard Rubber Company. Neoprene has been used indoors, but the pads have required internal longitudinal grooves within the neoprene pad to compensate for the excessive rigidity of the material. Neoprene also exhibits a comparatively large internal damping.

Given a pad that is highly resilient, creep resistant and temperature and time stable, its geometry and placement are selected to yield the desired compliance of the composite playing surface as well as a level of compliance that is substantially uniform over the surface. In physical terms, the compliance of the surface is due to a combined mechanical bending of the members 14, a mechanical compression of the pads 18, and, to a less extent, a bending of the support rails 17, primarily in the region between the pads 18. The bending or flexure is in response to the force or loading of the collision between the foot and the track. Peak loads during running are typically 3 times the weight of the runner. The extent to which each of these members contributes to the overall deflection of the surface depends primarily on the relative compliance of the members, their placement with respect to one another and the location of the foot impact on the track. For example, if the impact is in the middle of a member 14, it will absorb and return energy to the runner; the mode of energy storage is in large part a mechanical bending of the stiffly resilient upper surface members. However, if a runner is changing lanes and his foot lands above one of the support rails 17, the pads 18 are the principal elements receiving, temporarily storing, and then returning energy to the runner. The mode of energy storage is then almost exclusively a mechanical compression of the pad or pads.

Figure 4:
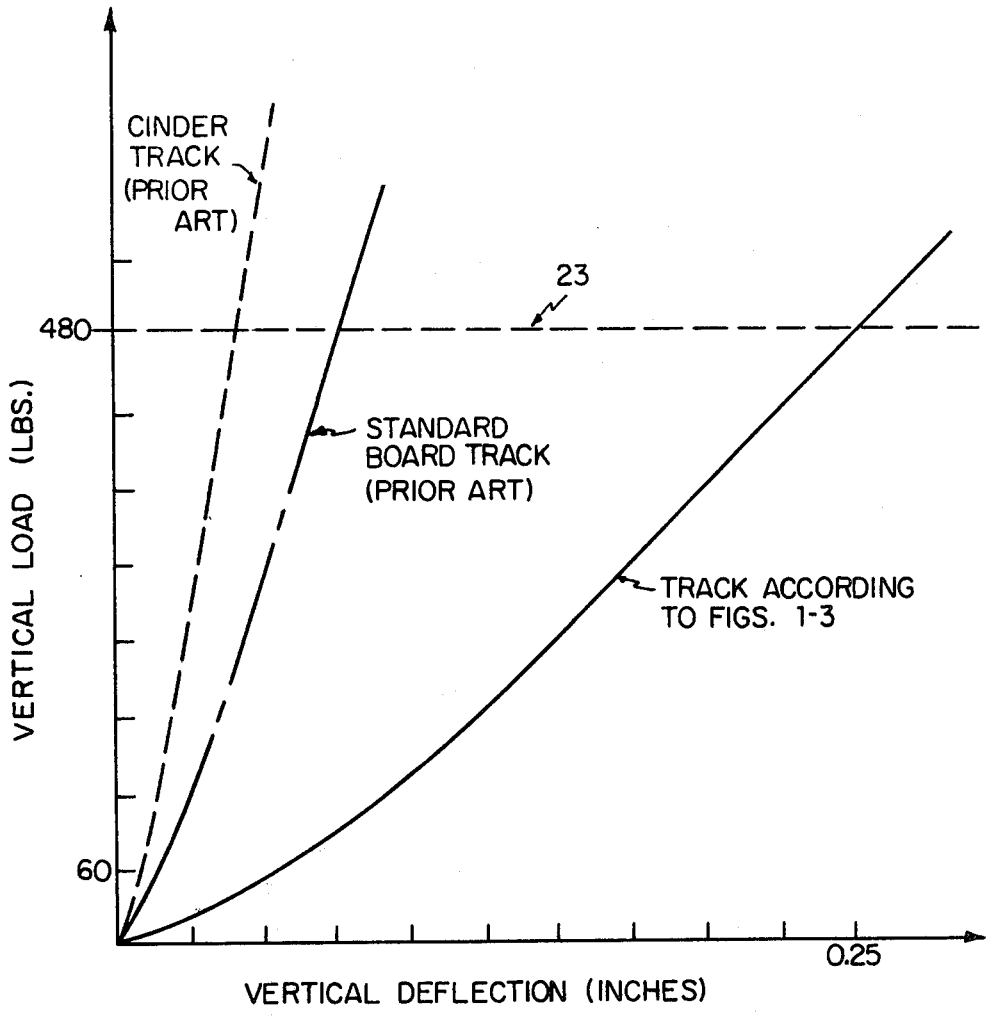
FIG. 4 is a graph showing the deflection of prior art running surfaces and one according to this invention as a function of applied force over a constant unit area.

Regardless of the relative contributions of the various elements forming the track, it is an important aspect of this invention that the composite playing surface structure presents a relatively large compliance or load deflection characteristic to an impacting foot. FIG. 4 graphically illustrates the load deflection characteristic of this invention as compared to several prior art running surfaces. The abscissa represents the vertical deflection of a playing surface, in inches; the ordinate represents the applied vertical load, in pounds (force). As is readily seen the load deflection curves for two conventional running tracks, one formed of cinders and the other a standard hardwood board track, are significantly steeper than the curve for the track 10. At a typical peak vertical force while running, indicated by the line 23, the deflection of the track 10 is more than three times that of the prior art tracks.

This large compliance, contrary to previously accepted understandings, is well "tuned" to receive, store momentarily, and return to the runner his energy in a highly efficient manner. A desirable value for this efficiency is 95%. A playing surface according to this invention is also "tuned" to minimize the time a runner's foot is in contact with the surface. Because of this minimization of foot contact time, the relatively large vertical compliance characteristic of this invention has the surprising result of increasing the speed of a runner. In competitive high speed running this invention has been found to increase running speed by 2 to 3 percent of the peak value obtained on hard surfaces with identical surfacetraction characteristics. This is equivalent to a 5 to 8 second speed increase for a 4 minute miler. A more general discussion of the interaction between a runner and a running surface is found in applicants' article "Harvard Bio-Mechanics Laboratory Report No. 78-1".

In general, it has been found that the advantages of this invention are optimized, for fast running, when the compliance is in the range of 2.0 to 3.0 the effective spring constant of the runner. (A discussion of the concept of a runner's spring constant and associated calculations are found in "Elastic Bounce of the Body" by Cavagna in *Journal of Applied Physiology* Vol. 29, No. 3, 1970, pp. 279–282). If the compliance is expressed as its inverse, a spring constant, a range of values which has been found to yield the advantages of this invention are 5,000 to 35,000 lbf./ft. For high speed, competition running, an optimal compliance is in the range of 20,000 to 25,000 lbf./ft. At compliances below 5,000 lbf./ft., the surfaces become excessively bouncy and interfere with an effecient energy transfer between the runner and the surface. At the other extreme, where the compliance exceeds 35,000 lbf./ft., the surface is sufficiently rigid that injuries commonly associated with running, such as shin splints, knee and ankle injuries, tend to occur with significantly greater frequency. Expressed still another way, it has been found that for high speed running, the optimal running surface should deflect vertically approximately ¼ inch when an athlete of average weight (160 lbs.) is running at full speed. For slower speed long distance running, the surface will typically deflect ⅜ inch.

The track 10, and more generally any athletic playing surface constructed according to this invention, has several other important characteristics besides a large compliance. These surfaces have a comparatively low effective vertical mass, that is, the apparent mass of the track presented to the athlete's foot as it collides with the track. More specifically, it has been found for best results that the surface should have an effective vertical mass per panel (e.g. half that of its real mass) less than approximately one tenth of the mass of a person, or animal, running on the surface. This requirement means that the member 14, or an equivalent structure, in addition to being stiffly resilient has a relatively low mass per unit area. Also, these surfaces have a very low horizontal compliance and a high effective horizontal mass. This means that there is a negligible loss of the runner's energy on impact as his foot moves the track laterally, as would be the case with thick artificial plastic surfaces.

Another important characteristic of a playing surface according to this invention is a generally uniform mechanical response over the track surface. This uniformity is primarily due to the resilience and placement of the pads 18. In the embodiment shown in FIGS. 1–3, the compliance of the members 14 will vary across the members. Without the pads 18, there would be almost no compliance if a runner's foot landed over a rail 17, as when he changes lanes. This would cause the runner to alter his cadence, and at least temporarily lose the speed, comfort and safety advantages of this invention. The pads 18, however, provide the necessary compliance and are therefore most important in providing a uniformity of the compliance over the playing surface. More specifically, the geometry and placement of the pads are designed to yield a playing surface with a compliance that is substantially uniform over the surface, preferably varying less than plus or minus 15% from one locale to another.

Since compression of a pad 18 provides substantially all of the deflection of the track 10 when an athlete lands on a rail 17, the pad preferably has a thickness at least twice the desired deflection of the track ($\frac{1}{4}$ inch) so that its total compression does not exceed 50%. Thus the maximum loading of the track determines the optimal thickness of the pad. Bumper pads according to this invention are typically $\frac{1}{2}$ inch to 1 inch thick. The face geometry of the pads 18 is generally not significant. The size of the pads is usually limited by the cost of the resilient material. Diameters or straight sides ranging from 1 inch to 3 inches are typical. It should be noted that while the pads 18 are shown as small, spaced elements, their function could be performed by a continuous resilient layer extending along the lower surface of each rail 17 or its equivalent. One drawback of this continuous form is its increased material cost. It should also be noted that the compliance of standard wooden track surfaces will typically vary by a factor of ten from one area to another. Therefore, variations in uniformity of 50%, which are readily achievable with this invention, are a major improvement, and variations within 15%, also achievable with this invention, are almost impossible for a runner to detect. Hence, with a tolerance of plus or minus 15%, the track feels perfectly uniform to the runner.

Finally, the stiff resilience of the upper surface members 14 is important in making the vertical mechanical response of the surface independent of the contact area between the foot and the surface. This is in sharp contrast to surfaces covered with thick layers of resilient plastics which have proven to be highly sensitive to the contact area. Thus, no matter whether an athlete lands on his heel, toe, or full foot, the track of our invention reacts the same way.

Returning to a more specific description of the high speed running track embodiment shown in FIGS. 1–3, while the G-10 material provides a long life (a track lifetime of 10–20 years at one million deflections per year) for the members 14, other more economical materials can be used where a shorter life can be tolerated. Examples of these other materials are Sitka spruce ($\frac{3}{4}''\times5\frac{1}{2}''\times3'$), plywood ($\frac{3}{4}''\times16''\times3'$) and combination members having a plywood inner core and a glass fabric resin impregnated outer layer.

The members 14, as shown in FIG. 1, are spaced apart from one another by a gap 20 to allow each member to deflect independently. The size of the gap 20, is preferably $\frac{1}{4}$ inch to $\frac{1}{2}$ inch so that a continuous, overlying resilient layer 21 can readily follow the motion of the surface members 14 when they deflect. The gap should not be larger than about $\frac{3}{4}$ inch when a layer top 21 is not used since there is some danger that a runner will catch the toe of his shoe in the gap.

The track 10 is preferably covered with the layer 21 which bridges the gaps 20 between adjacent members 14, and offers good traction for running, particularly where the runner uses needle-spiked running shoes. The layer 21 can be of various materials such as the aforementioned artificial turfs, namely, Tartan from Minnesota Mining & Manufacturing or Chem-Turf, available through C.P.R. Industries, Braintree, Massachusetts. Although the surface layer can be applied according to usual techniques, it may be necessary to caulk the gaps 20 prior to application. The caulking can then be removed after the artificial turf dries so that members 14 can flex independently of one another. A resilient layer 21 that is about $\frac{3}{8}$ inch thick is satisfactory. Also, instead of caulking, a yieldable glass fabric layer can first be applied to the upper surface of the members 14 with the resilient layer 21 applied over it.

The rails 17 may be conventional wooden 2×4's. Spruce is somewhat less resilient than desired, but it is more economical. A preferred length for the rails is eight feet. The rails can also be metal such as aluminum I-beams. More compliant, and therefore more desirable, rails can be formed from the aforementioned "G-10" molded with suitable dimensions and shape. The rails 17, as shown in FIG. 1 of the drawing, are parallel with respect to one another, and are placed in these parallel rows, end-to-end, to form a track of any overall length. Curved rails of wood for circular or oval tracks are provided according to usual techniques.

The members 14 are assembled to the support rails 17 to minimize stress concentrations which encourage crack growth in fiberglass and ultimately lead to failure of the members. Accordingly, the components of the track 10 are preferably secured adhesively rather than by screws or nails, as is conventional. An adhesive such as an epoxy resin can be used to secure the upper flexible members 14 to the rails 17. The members 14 are positioned on rails 17 with their longer edges perpendicular to the rails. The pads 18 can be held in place between the rails 17 and the base 19 by the weight of the overlying track or preferably with a suitable adhesive. Conventional fasteners, such as staples or tacks are also acceptable.

Figure 5:
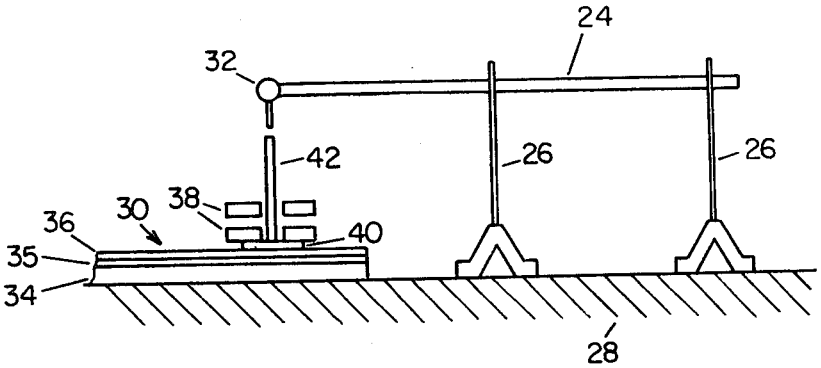
FIG. 5 shows a test apparatus for generating data presented in FIG. 1.

FIG. 5 shows a test apparatus 22 used to generate the data reflected in FIG. 4. An aluminum bar 24 with cross sectional dimensions of $\frac{1}{4}$ inch by 2 inches is held horizontally in a pair of ring stand supports 26, 26 resting on a base 28 corresponding to the base 19 in FIGS. 1–3. The playing surface 30 to be tested is positioned on the base 28 under an end of the bar 24 which supports an Ames displacement gauge 32 which can measure movement to within ±0.001 inch. As shown, the surface 30 includes 2×4 inch rails 34, a sheet 35 of plywood overlying the 2×4's and a resilient plastic top layer 36. The deflection load is supplied by removable weights 38 carried on an aluminum shoe 40 having a five inch diameter. The five-inch diameter was selected because it is about equal to the surface area of an average man's size 10 shoe. A rod 42 connects the loaded shoe 40 to the displacement gauge 32 to transmit the displacement of the surface 30 induced by the weights to the gauge where it is measured.

Figure 6:
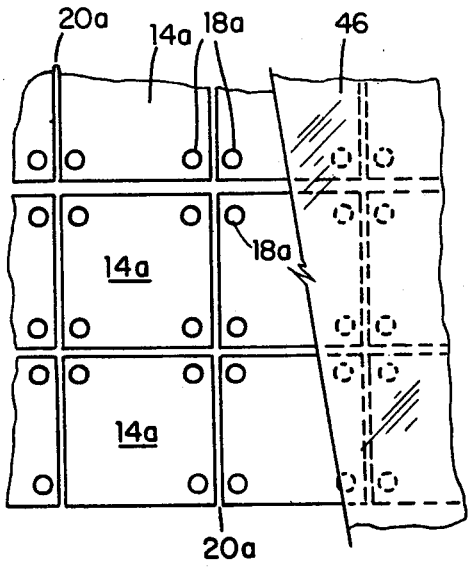
FIG. 6 is a top plan view with portions broken away of an alternative playing surface according to this invention utilizing a mosaic array of square upper surface members.
Figure 8:
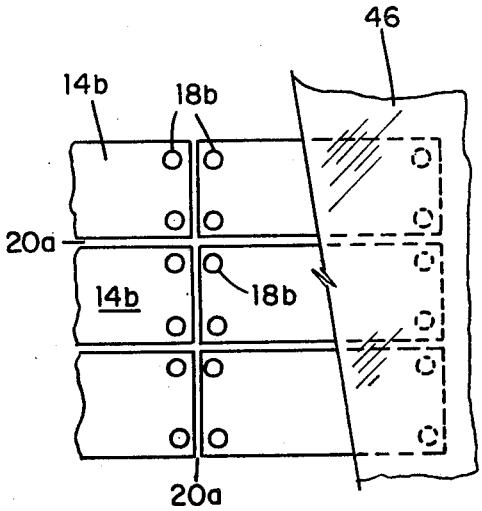
FIG. 8 is a plan view corresponding to FIG. 6 of a playing surface utilizing a mosaic of rectangular upper surface members.
Figure 7:
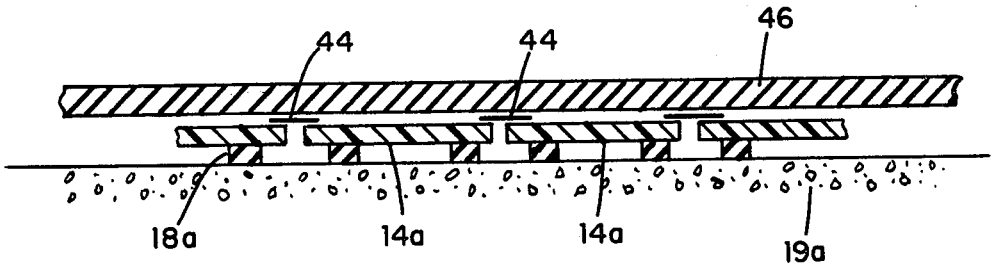
FIG. 7 is a view in vertical section of the playing surface shown in FIG. 6.

FIGS. 6–8 illustrate alternative embodiments of this invention characterized by a mosaic array of upper surface members **14*a* and 14*b* in a co-planar, closely spaced relationship and the absence of underlying rail-like support elements. The members 14*a* are preferably 2 foot squares of materials such as fiberglass, fiberglassed plywood, or in the most economical form, $\frac{3}{4}$ inch ordinary plywood. The members 14*b* are preferably 1 by 3 foot rectangles of the same materials, except that the plain plywood is 1.0 inch thick to accommodate the 3 foot span. Each member 14*a*, 14*b* is supported on four bumper pads 18*a*, 18*b*, respectively, located near the corners of respective panel members. The pads 18*a*, 18*b*, like pads 18, are preferably a highly resilient, durable material such as rubber and formed into 2 inch diameter circles or squares 2 inches by 2 inches by $\frac{3}{4}$ inch. In turn, as is best seen in FIG. 7, the pads 18*a*, 18*b* bear directly on a firm substrate 19*a* of concrete, asphalt or the like. Each member 14*a* and 14*b* is separated by a narrow, preferably uniform, gap 20*a*** which allows the member to deflect independently of other members.

The gaps are spanned by a suitable flexible tape 44 which allows an upper rubberized surface 46 to be poured over the mosaic. When the top layer 46 cures and solidifies, it serves the same function as the layer 21 in the FIGS. 1–2 embodiment. In addition, if the pads 18*a*, 18*b* are not bonded in place, it secures the members 14*a*, 14*b* in a horizontal orientation when an athlete lands on an edge of a member 14*a* or 14*b*.

As with the rail embodiment of FIGS. 1–3, the selection of materials and the placement of the pads 18*a*, 18*b* must be directed to yield a composite playing surface that has a large vertical compliance, low effective vertical mass, a uniformity of mechanical response and other operational characteristics delineated above. Thus, while the four-corner placement of the pads 18*a*, 18*b* is usually recommended, it may sometimes be advisable to use additional pads such as a fifth pad approximately centered on each member, particularly the rectangular members 14*b*. In general, a closer spacing of the pads results in a more uniform compliance. When properly constructed the mosaic embodiments offer good uniformity over a large extended surface and are relatively inexpensive to construct.

Figure 9:
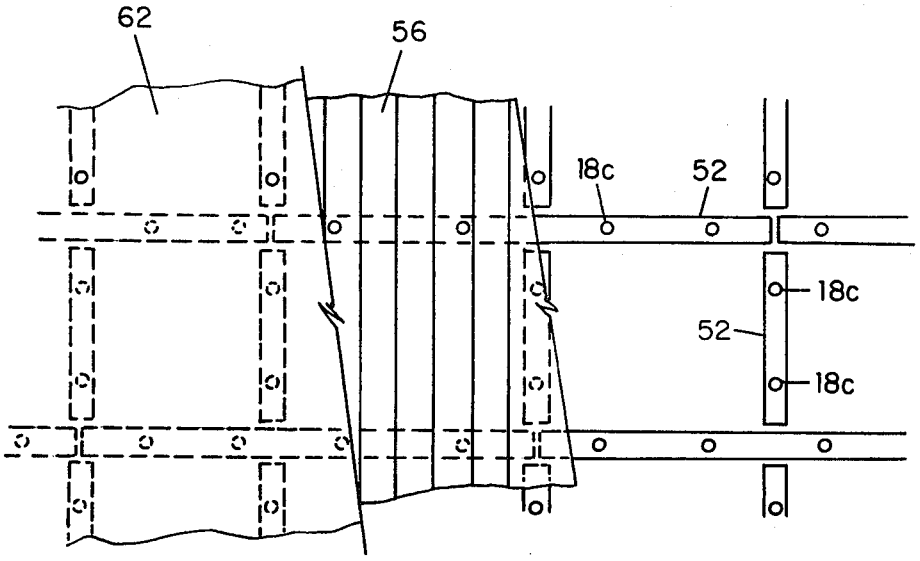
FIG. 9 is a top plan view of an alternative playing surface, with portions broken away, suitable for outdoor use and utilizing low cost building materials.
Figure 10:
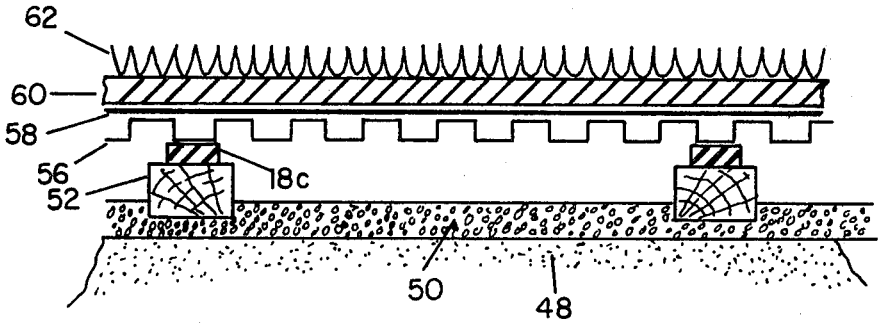
FIG. 10 is a view in vertical section of the playing surface shown in FIG. 9.

FIGS. 9 and 10 show an alternative embodiment of a playing surface according to this invention particularly adapted for outdoor use and a low construction cost using commonly available materials. To construct this surface, the ground 48 is graded level and covered with a uniform layer of fine gravel or crushed rock 50 to provide adequate drainage. A checkerboard of railroad ties 52 is then laid over the gravel. The ties can be the standard 4 foot length, or 4 foot and 8 foot lengths to reduce cost. The railroad ties are treated, as usual, to resist deterioration. Next two bumper pads 18*c* are placed on the upper surface of each railroad tie. The composition, geometry and location of the pads is governed by the principles previously discussed. The pads are secured to the ties using adhesives or preferably fasteners.

The upper surface 54 is formed by a layer of corrugated steel deck 56, an overlying layer 58 of thin sheet steel which is riveted to the deck, thin plywood ($\frac{1}{4}$ or $\frac{3}{8}$ inch) or Wolmanized (creosote soaked) plywood lumber secured to the deck with sheet metal screws, a rubber pad layer 60 and an upper layer of artificial turf 62 (such as Astroturf). The rubber pad 60 is recommended for football or soccer to absorb the impact of a fall, but not for running tracks. In contrast to the embodiment discussed previously, the upper surface in this embodiment is not necessarily formed of relatively small independent panels. Rather, the layers 56–62 are typically large (i.e. 4'×24' or similar standard sizes), continuous sheets of corrugated steel pieced together to cover the playing surface. However, as with the previous embodiments, the composite compliance of the pads 18*c* and the upper surface 54 is within the desired ranges to enhance running speed and reduce injuries. Variables such as corrugation width and height, and steel gauge can be arranged to produce optimal conditions. It should be noted that the steel deck of this embodiment makes it difficult to minimize vibrational cross-talk. This disadvantage is traded for the cost advantage of using large, inexpensive, conventionally sized corrugated steel deck.

The construction of FIGS. 9 and 10 is particularly adapted to covering large outdoor playing areas such as football fields. In this regard, it should be noted that although this construction uses artificial turf, it is a relatively thin layer which will not substantially detract from the overall compliance of the surface as the turf hardens over time, and at low temperatures. By contrast, our invention is stable over time because of the choice and location of materials. Also, this construction allows for drainage at the center of the field, simply by locating small drainage holes through members 62, 60, 58 and 56. Existing Astroturf football fields are only drained at their periphery, thus requiring a "humped" field to encourage the water to run off. The humped field is both expensive and undesirable. The present embodiment of our invention therefore avoids this problem completely.

Figure 11:
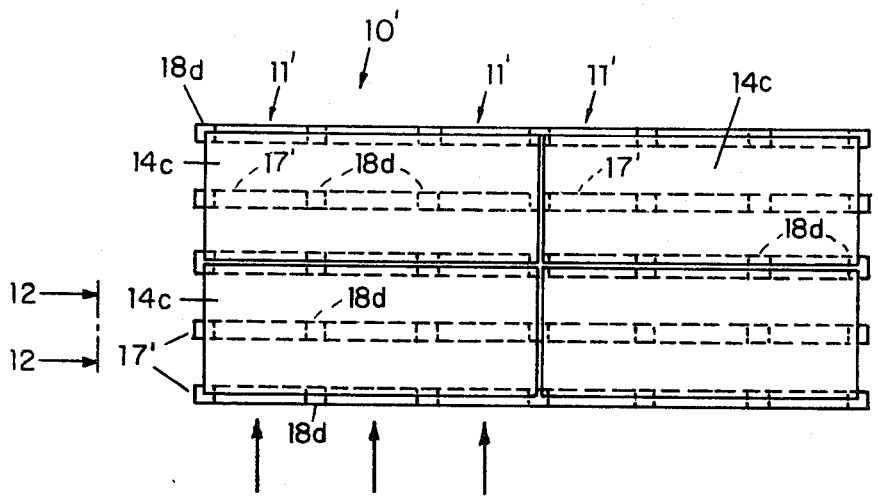
FIG. 11 is a top plan view of an alternative playing surface, according to this invention that is adapted as a six lane running track and with its top rubberized surface removed.
Figure 12:
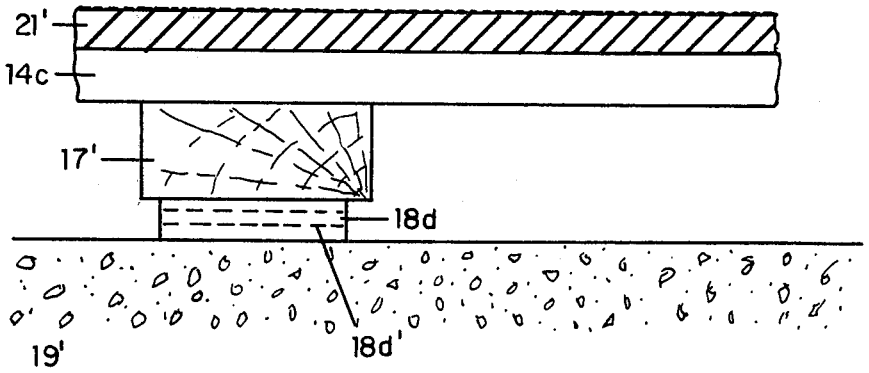
FIG. 12 is a detail view in vertical section taken along the line 12–12 of FIG. 11.

FIGS. 11 and 12 show a portion of another playing surface according to the invention adapted as a running track 10' divided into six lanes 11', each typically three feet wide. As with embodiments discussed above, an upper surface having a low mass per unit area and stiffly resilient is formed by an array of panels 14*c*. In contrast to the embodiments of FIGS. 1–3 or FIGS. 6–8, the panels 14*c* are each comparatively large in surface area, e.g. 4 feet by 9 feet and oriented to span three running lanes 11'. In an extremely economical form, the panels 14*c* are conventional $\frac{3}{4}$ inch plywood. As in the FIGS. 1–3 or FIGS. 6–8 embodiments, a thin continuous rubberized surface 21' such as a $\frac{3}{8}$ inch layer of "Astroturf" preferably covers the panels 14*c*.

The upper surface of panels 14*c* is supported over a rigid base 19' of asphalt or concrete by a series of stringers 17' that directly support the panels 14*c* and an array of pads 18*d* interposed between the stringers 17' and the base 19'. The stringers 17' and pads 18*d* function in the same manner as the rails 17 and the pads 18 of the FIGS. 1–3 embodiment. One difference is that the stringers 17', typically 2×3 wooden beams, are oriented perpendicular to the direction of running and with their broad face abutting the panels 14*c*. Another difference is that the pads 18*d*, for reasons of cost, are formed of neoprene with a series of central channels 18*d'* designed to enhance the resiliency of the pads. The various members forming the track 10' can be assembled simply by conventional nailing. The track 10' is primarily an indoor track, oval in shape, and will usually include conventional wooden constructions to support the panels 14*c* at the proper inclination. At such banked panels, the stringers 17' will still directly support the panels 14*c*, but the pads 18*d* will usually be located directly on the base 19', at the edges of the lanes.

The stringers are mutually parallel and preferably three evenly spaced stringers support each panel 14*c*. The pads 18*d* are uniformly spaced with the pads aligned with an associated stringer as well as along the edge of each lane 11'. As before, the track 10' is characterized by a large vertical compliance, a low effective vertical mass, a low horizontal compliance, a large effective horizontal mass, and a mechanical response to the impact of a runner's foot that is substantially uniform over the surface and substantially independent of the foot contact area. A significant advantage of this invention is that even though the track 10' is not formed of the optimum materials, or using the most desirable construction techniques, it is nevertheless a high performance track that has produced significant increases in running speed, substantial reduction in injuries, and has won wide acclaim.

Figure 14:
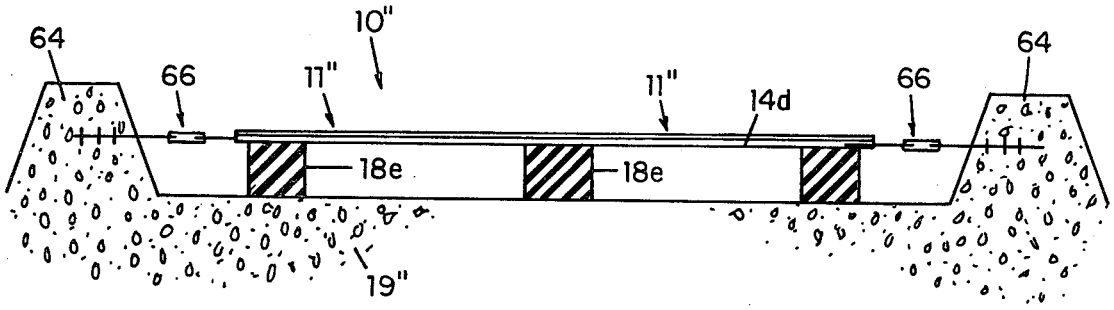
FIG. 14 is a view in vertical section of the track shown in FIG. 13.
Figure 13:
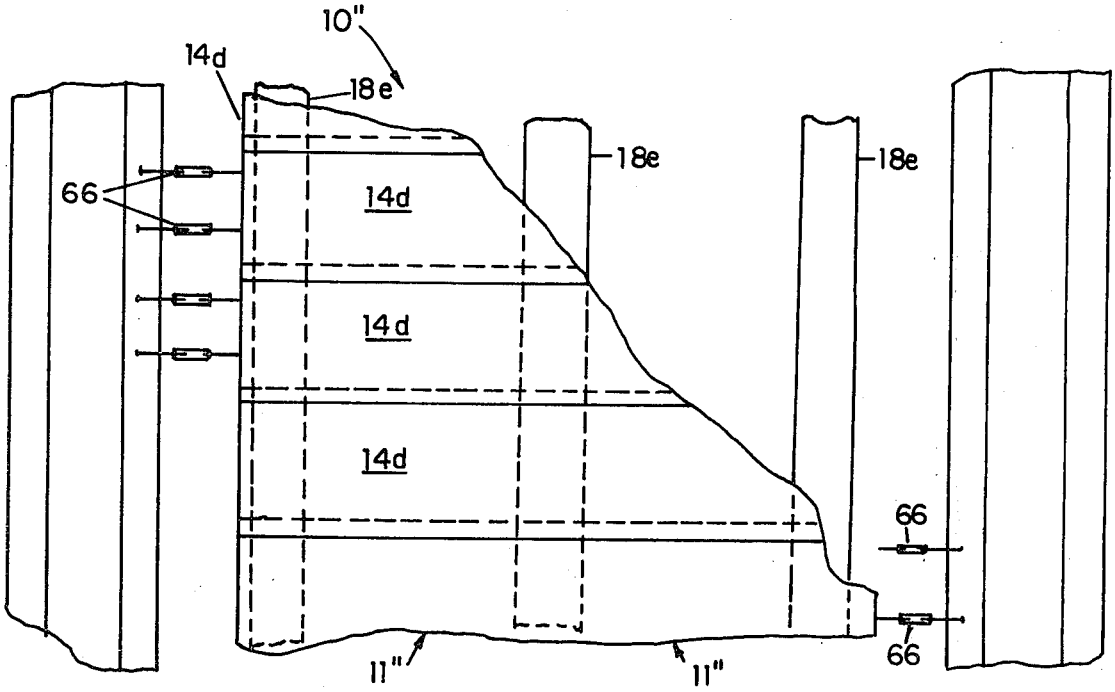
FIG. 13 is a top plan view of an alternative playing surface according to this invention where the vertical compliance of the surface is adjustable.

FIGS. 13 and 14 show a portion of another playing surface according to the invention adapted as a running track 10''. Two lanes 11'', 11'' are shown, but any number of lanes are readily provided. A rigid base 19″ is provided as before, but is terminates at its edges in two bulkheads 64,64 that each extend along the surface 10″, which is usually in a conventional oval shape.

The upper surface of the track 10″ is formed by a series of thin panels or sheets 14*d* of metal that each extend in one continuous strip across the running lanes and overlap one another along their longitudinal edges in the manner of roof shingles. The sheets 14*d*, like the resilient upper surfaces described previously, have a low mass per unit area and are stiffly resilient. For example, each sheet 14*d* can be a 2 foot wide strip of 1/16 inch stainless steel. A rubberized top surface will usually cover the sheets 14*d*.

The sheets 14*d* are supported by a set of highly resilient members 18*e* in the form of strips 18*e* oriented in the running direction and positioned at the edges of the track and between lanes. The strips 18*e* are preferably silicone rubber. The strips 18*e* extend vertically from the base 19″ to the underside of the sheets 14*d*. The sheets are also supported laterally by turnbuckles 66 that are each anchored at one end in the bulkheads 64,64 and secured at the other end to an edge of one sheet 14*d*. Preferably four turnbuckles support each sheet, two on each side.

For a given setting of the turnbuckles the track 10″ has a certain vertical compliance within the ranges specified above. This compliance is due to the flexure and stretching of the sheets on impact and the compression of the strips 18*e*. Also as noted above, for a runner weighing approximately 160 lbs., the track 10″ deflects vertically about ¼ inch for fast running. However, if the track is used for long distance running events, usually more than a few miles, it has been found that runners run at an average speed that is frequently 50 to 70% of their fastest speed. At these slower speeds, the enhanced speed advantages of this invention require an increased vertical compliance, typically about four times the compliance of a "fast" track. This corresponds to a vertical deflection of the track of about one inch on impact by a runner's foot. A major advantage of this embodiment is that such wide variations in compliance can be proved by adjusting the turnbuckles 66 to produce the desired lateral tension across the sheets 14*d*. Thus adjusting the turnbuckles, "tunes" the track to a particular running event or a particular class of runner, e.g. children, adults, high quality runners, etc. It should be noted, however, that this track is somewhat more susceptible to vibrational cross talk and significantly more costly to manufacture than other embodiments described herein.

There has been described an extended athletic playing surface that increases the speed of runners on the surface and reduces injuries. The invention also provides a surface that has a substantially uniform mechanical response over the entire playing area. Other very significant features and advantages are that its mechanical responses are substantially independent of the foot contact area, in many embodiments there is little or no vibrational cross talk between adjacent portions of the playing surface, and many embodiments offer all of these advantages at a comparatively low cost of manufacture using conventional, readily available materials.

While this invention has been described with reference to its preferred embodiments, it will be understood that other variations are possible. For example, the resilient members can be formed from a variety of materials including springs. The shape dimensions, and relative placement of the various component members can also vary as long as the composite, multi-layer structure has the specified vertical compliance and other characteristics enumerated above. For example, for highly curved surfaces such as steeply banked running tracks it may be desirable to use smaller upper surface panels than otherwise so that the mosaic array of panels closely approaches a smoothly curved surface. Another variation is that while the bumper pads have been described as small, discrete members or strips of a resilient material, it is possible, although probably economically prohibitive, to perform their function with a continuous sheet of suitable resilient material. Also, while only a few applications have been described (running tracks, football fields), it will be understood that this invention has a wide applicability. For example, playing surfaces according to this invention can be used for soccer, track and field events such as pole vaulting, baseball, tennis, and animal racing sports such as dog tracks or horse racing tracks. These and other modifications and variations will be apparent to those skilled in the art from the accompanying drawings. Such modifications and variations are intended to fall within the scope of the appended claims.

What is claimed and secured by Letters Patent is:

1. An extended athletic playing surface that receives repeated running impacts comprising, an upper surface formed of a plurality of surface members in side-by-side relationship, each of said surface members being stiffly resilient and substantially independent of others of said members in its response to said impacts, means for supporting each of said surface members so that the flexural response of each of said surface members is substantially independent of the response of others of said surface members, said support means including a plurality of discrete members supporting each surface member, each discrete member formed of a highly resilient material to provide an efficient return of the energy of said running impacts to the runner, said support means being arrayed with respect to said surface members to form an operative combination characterized by a large vertical compliance, a low horizontal compliance, and a low effective vertical mass, and means for holding said surface members on said support means.

2. An athletic surface according to claim 1 wherein said compliance is equivalent to a spring constant in the range of 5,000 to 35,000 lbf./ft., said range assuming a load range of 2 to 3 times the runner's weight applied over a five inch diameter rigid surface.

3. An athletic surface according to claim 1 wherein said compliance is in the range of 20,000 to 25,000 lbf./ft.

4. An athletic surface according to claim 1 wherein said compliance, expressed as a spring constant, is approximately 2.0 to 3.0 times the effective spring constant of the runner on said surface.

5. An athletic surface according to claim 1 wherein said compliance, expressed as a maximum vertical deflection of said surface developed by said running impact of a runner of average mass, is approximately ¼ of an inch.

6. An athletic surface according to claim 5 wherein said support means includes a resilient material that has substantially no creep and is substantially thermally stable.

7. An athletic surface according to claim 6 wherein said resilient material is a silicone rubber.

8. An athletic surface according to claim 1 wherein said resilient members have a thickness in excess of $\frac{3}{8}$ of an inch.

9. An athletic surface according to claim 1 wherein approximately half of said compliance is due to a flexure of said upper surface and approximately half of said compliance is due to a compression of said resilient members supporting said flexed surface when said impact occurs on said upper surface approximately midway between said resilient members.

10. An athletic surface according to claim 1 wherein said vertical effective mass is less than approximately one-tenth the mass of the runner on said surface.

11. An athletic surface according to claim 1 wherein said independent surface members are panels of a glass fiber reinforced resinous material.

12. An athletic surface according to claim 1 wherein said independent surface members are panels of plywood.

13. An athletic surface according to claim 1 wherein said independent surface members are a panel of fiberglass reinforced plywood.

14. An athletic surface according to claim 12 or claim 13 wherein said support means comprises a plurality of discrete, highly resilient members disposed in spaced apart relation under each of said panels.

15. An athletic surface according to claim 1 wherein said deflection response varies over said surface to within plus or minus 15 percent.

16. An athletic surface according to claim 1 wherein said resilient members have vertical thickness in the range of $\frac{1}{4}$ to 1 inch.

17. An athletic surface according to claim 1 wherein said playing surface is delineated into lanes extending generally in a first direction, said panels each span at least one lane, at least two elongate support members extend in parallel spaced relation under each of said panels in a direction generally transverse to said first direction, and said resilient members are aligned generally with the lateral edges of said lanes.

18. An athletic surface according to claim 1 wherein said playing surface is delineated into lanes, said elongate members extend generally in said first direction along the lateral edges of said lanes, said panels are each suspended across an adjacent pair of said elongate members, and said resilient members are aligned with said elongate members.

19. An athletic playing surface according to claim 1 wherein said surface members and said support means in operative combination being characterized by a deflection response to said running impacts that is substantially independent of both the point of said impact on said surface and the impact area.

20. An athletic playing surface according to claim 1 wherein said surface members each have a low vertical mass per unit area.

21. An extended athletic playing surface that receives repeated running impacts comprising, an upper surface formed of a plurality of surface members in side-by-side relationship, each of said surface members being stiffly resilient and substantially independent of others of said members in its response to said impacts, means for individually supporting each of said surface members so that the flexural response of each of said surface members is substantially independent of the response of others of said surface members, said support means comprising a plurality of discrete sets of pads formed of a highly resilient material, each of said sets being located below and uniquely associated with one of said surface members, said sets of pads providing an efficient return of the energy of said running impacts to the runner, said support means being arrayed with respect to said surface members to form an operative combination characterized by a large vertical compliance, a low horizontal compliance, and a low effective vertical mass, and means for holding said surface members on said support means.

22. An extended playing surface according to claim 21 further comprising a thin layer of a resilient plastic material which overlies said surface members.

23. An extended playing surface according to claim 22 further comprising a resilient connecting means that extends between said surface members and underlies said thin resilient layer.

24. An extended playing surface according to claim 21 wherein said surface members have a generally rectilinear configuration and said sets of pads each include at least four pads with one pad disposed generally adjacent each of the corners of said associated surface member.

25. An extended playing surface according to claim 24 wherein said panels have lateral dimensions of less than four feet.

26. An extended playing surface according to claim 21 wherein said vertical compliance is equivalent to a spring constant in the range of 5,000 to 35,000 lbf./ft., said range assuming a load range of 2 to 3 times the runner's weight applied over a five inch diameter rigid surface.

* * * * *